United States Patent [19]

Gibson

[11] Patent Number: 4,555,066

[45] Date of Patent: Nov. 26, 1985

[54] REPLACEABLE ROLL FOR ROLLER MILL

[75] Inventor: William D. Gibson, P.O. Box 345, Troutdale, Oreg. 97060

[73] Assignee: William D. Gibson, Portland, Oreg.

[21] Appl. No.: 513,151

[22] Filed: Jul. 12, 1983

Related U.S. Application Data

[63] Continuation-in-part of Ser. No. 214,207, Dec. 8, 1980, abandoned.

[51] Int. Cl.[4] ..... B02C 15/08

[52] U.S. Cl. ..... 241/293; 29/123; 241/129

[58] Field of Search ..... 241/236, 110, 285 R, 241/293, 294, 295, 111, 133, 112, 120, 107, 117, 131, 121, 129; 51/168; 29/123, 124, 125, 130

[56] References Cited

U.S. PATENT DOCUMENTS

| | | | |
|---|---|---|---|
| 488,759 | 12/1892 | Gates | 241/293 |
| 946,416 | 1/1910 | Williams | 241/293 X |
| 3,721,391 | 3/1973 | Lepola | 241/293 |
| 3,991,944 | 11/1976 | Baikoff | 241/236 X |
| 4,046,324 | 9/1977 | Chambers | 241/236 X |
| 4,232,834 | 11/1980 | Player et al. | 241/293 |

OTHER PUBLICATIONS

Roller Mills, Bulletin No. 112, C-E Raymond Combustion Engineering, 11-1979.

*Primary Examiner*—Mark Rosenbaum
*Attorney, Agent, or Firm*—Klarquist, Sparkman, Campbell, Leigh & Whinston

[57] ABSTRACT

A replaceable roll for mounting on a tapered threaded shaft of a roller mill includes a generally cylindrical roll member of wear-resistant cast material having an axial bore defined by a central bore wall portion raised with respect to a first bore end wall portion and recessed with respect to an opposite second bore end wall portion. The first bore end wall portion is of a preferably noncircular, polygonal configuration and receives a removable complementary annular end insert which abuts an annular shoulder formed at the interface of the central bore wall portion and first bore end wall portion. The bore of the end insert and the second bore end wall portion are axially tapered to correspond to the taper of the shaft onto which the roll is to be mounted. The taper of the second bore end wall portion forms a progressive continuation of the taper of the bore of the end insert for receiving the tapered threaded shaft. In one embodiment the annular shoulder of the roll member and shoulder-abutting portion of the insert define mating tapered laterally interfering surfaces which resist lateral and axial movement between such members.

5 Claims, 8 Drawing Figures

FIG. 1
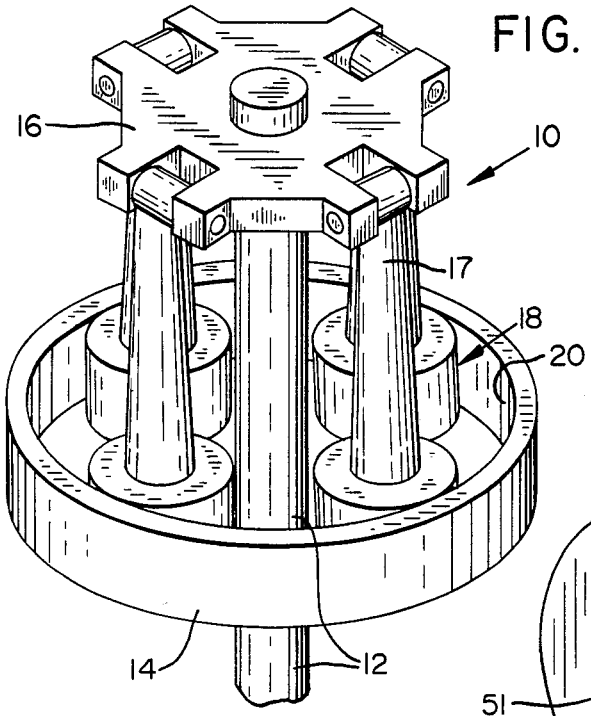
FIG. 2
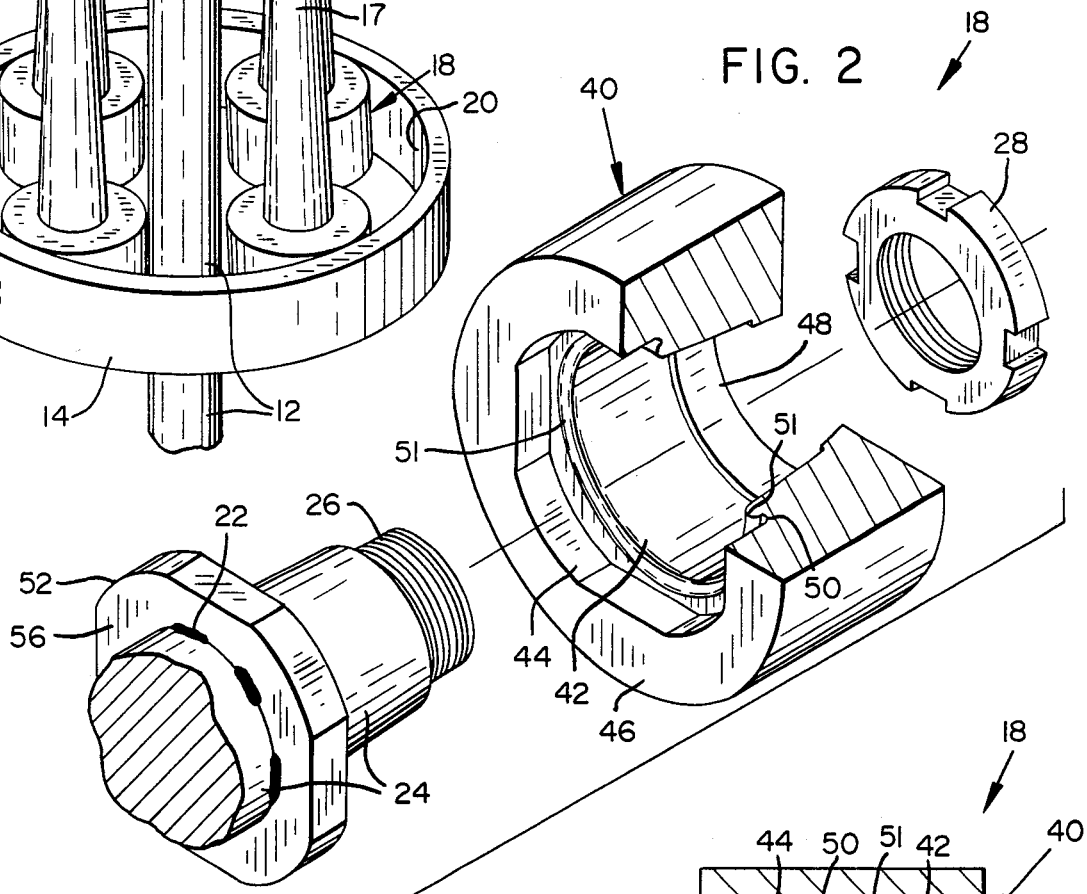
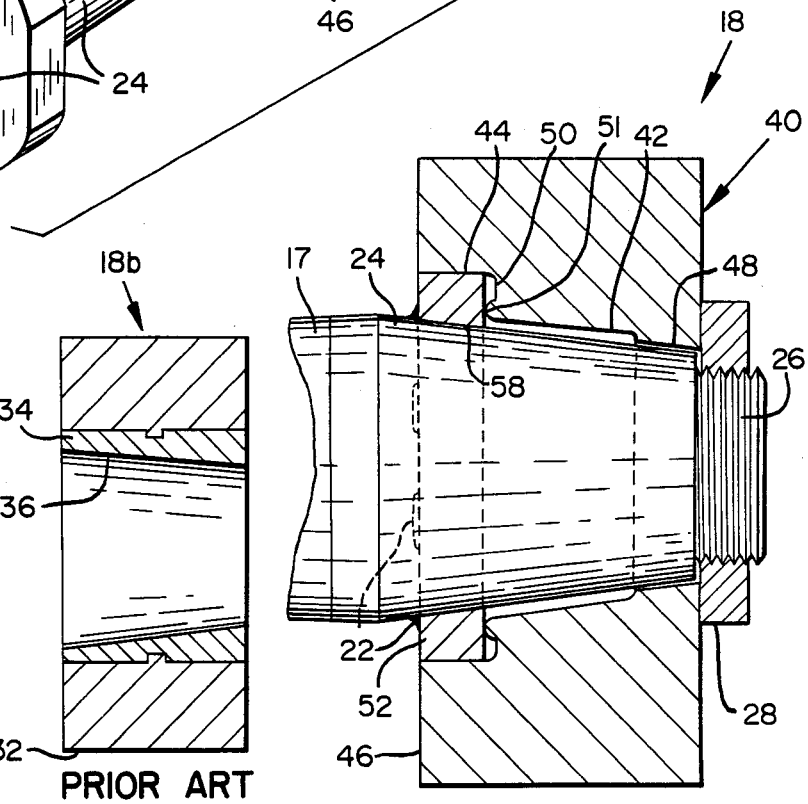
FIG. 3
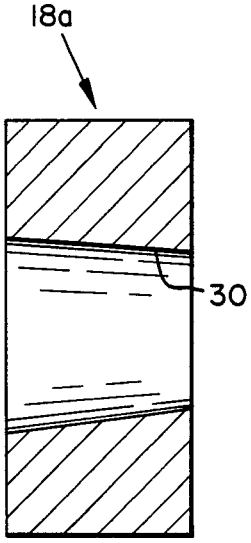
PRIOR ART
FIG. 4
PRIOR ART
FIG. 5

FIG. 6
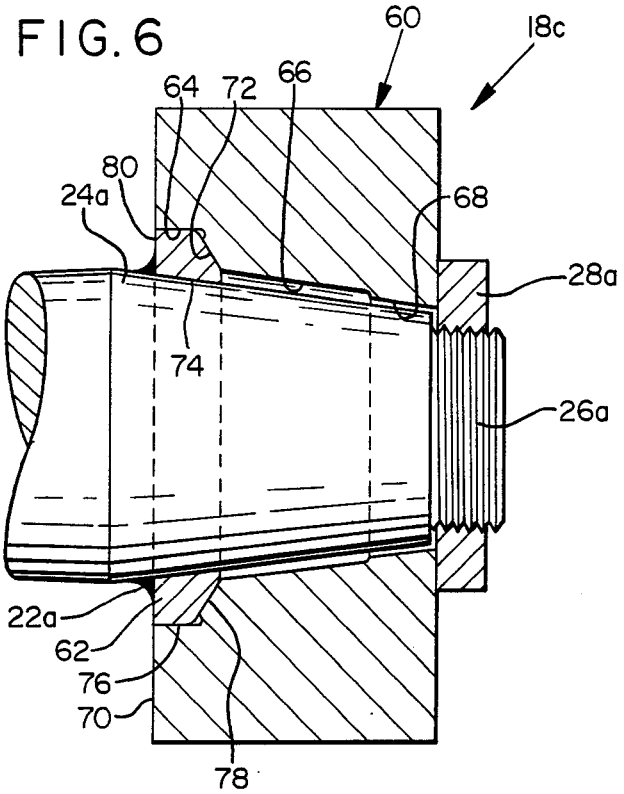
FIG. 8
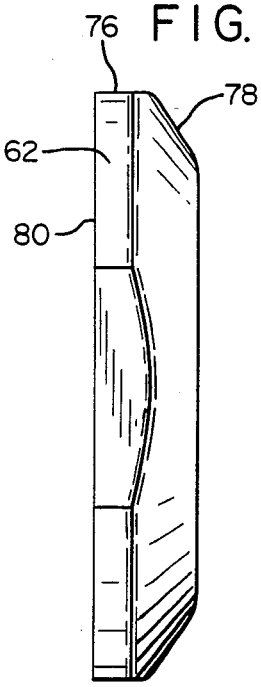
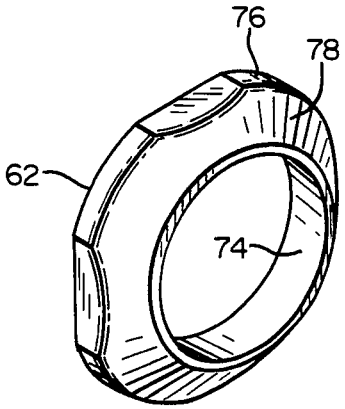
FIG. 7

REPLACEABLE ROLL FOR ROLLER MILL

RELATED APPLICATIONS

This application is a continuation-in-part of copending application Ser. No. 214,207, filed Dec. 8, 1980 now abandoned.

BACKGROUND OF THE INVENTION

1. Field of the Invention

The present invention relates to roller mills for pulverizing, or grinding, various mineral materials. The invention relates more particularly to the construction of pulverizing rolls for a roller mill of the type in which the pulverizing rolls are mounted on a tapered threaded shaft and secured by a nut.

2. Description of the Prior Art

Pulverizing rolls are typically made of a very hard, wear-resistant cast metal. Such metal is extremely difficult to machine. However, in pulverizing rolls of the type mounted on tapered threaded shafts, a precision tapered bore is often required, or at least desired, to fit accurately on the shaft.

In the past the required precision tapered bore has been provided by either hand grinding or precision machine grinding the inner bore walls of a monolithic roll member made of the aforementioned hard cast metal, as shown in FIG. 4 of the drawings. However, this method of manufacture is extremely expensive because of the difficulty of hand grinding or precision machine grinding the bore. Also, when the roll has wornout, it has to be discarded and replaced with a similar roll having the same disadvantage.

In another prior roll construction and method of manufacture, shown in FIG. 5 of the drawings, the hard metal outer roll material has been cast about an inner sleeve made of a machineable metal, and the inner sleeve has been precision machined to the required taper. While this method of manufacture is less expensive than the aforementioned method because the precision machining of the correct taper on the machineable inner sleeve is easier than grinding or machining such taper on the hard cast metal roll material itself, the method still leaves much to be desired. When the roll wears out and is in need of replacement, the entire roll, including the inner sleeve, must be discarded. Also, a roll of this type is still considerably more expensive than a roll which requires little or no machining or grinding of the taper.

Roller mills of the aforementioned type have journal bearings which permit the tapered, threaded shafts to rotate relative to their supporting arms. Since the rolls on such shafts rotate with the shafts and are used to grind minerals and other substances to a fine powder, they operate in a dusty environment. The powder tends to invade the journal bearings and increase friction therein. As the friction increases, the torque tending to cause the roll to rotate about the shaft also increases. When the resistance to rotation between the journal bearings and the shaft becomes greater than the resistance between the roll and shaft, the roll begins to rotate about the shaft. Because the rolls are cast of a very hard metal and the shafts are usually made of a relatively soft machineable steel, the rotation of the roll about the shaft can quickly result in destruction of the shaft's machined surface. The expensive shaft must then be discarded, and further cost incurred in disassembling and reassembling the components. Also, once the roll becomes loose on the shaft, the nut tends to loosen. In extreme cases, the nut unscrews from the shaft, thereby allowing the roll to drop off and cause extensive damage to the roller mill assembly.

Many attempts have been made to avoid these consequences, such as by tightening the nut as tightly as possible, tack-welding the roll to the shaft, tack-welding the nut to the shaft, or placing a bar across the end of the shaft and welding it to the shaft and nut. All of these measures are undesirable because they tend to damage the shaft and reduce its useful life, and make it difficult to remove the roll from the shaft. They are also time-consuming and thus costly.

Accordingly, there is a need for a simpler, less expensive pulverizing roll which will mount on a tapered threaded shaft, will not slip or rotate about the shaft and can be quickly and easily replaced when worn-out.

SUMMARY OF THE INVENTION

The present invention is a new and improved pulverizing roll for mounting on a tapered threaded shaft which will not slip or rotate about the shaft, can be quickly and easily replaced when worn-out, is less costly to manufacture and replace than prior such rolls, and requires virtually no grinding or precision machining.

In the present invention the foregoing advantages are achieved by providing a pulverizing roll in two separable parts. A first part is an outer replaceable roll member of hard, wear-resistant material having an axial bore which requires no precision machining. The second part is a noncircular, reusable end piece insert which is insertable into a complementary-shaped recess in the end of the outer roll member. The insert has an axial bore with a precision-machined, tapered bore wall which conforms to the taper of the tapered shaft for accurate engagement with it. The insert is nonrotatably affixed, as by tack-welding, to the shaft. The insert, because of its noncircular shape, provides a positive driving connection between the roll and shaft to prevent slippage of the roll about the shaft. When the outer hard cast metal roll member wears out and requires replacement, the old roll member is simply removed from the shaft and replaced with a new one. The insert remains affixed to the shaft and is thus reusable indefinitely. The result is a pulverizing roll assembly of simplified construction and low replacement cost since the only part requiring precision machining, the insert, need not be replaced when the roll member wears out.

It is therefore one object of the invention to provide an improved pulverizing roll for mounting on a tapered threaded shaft of a roller mill, the roll being of a simplified low-cost construction and having a low replacement cost.

Another object of the invention is to provide an improved pulverizing roll, as aforesaid, which is quickly and easily replaceable when worn out.

A further object of the invention is to provide a pulverizing roll, as aforesaid, including a roll member of monolithic, hard castable material which can be used substantially in its as-cast condition, with only minimal amounts of machining or grinding.

An additional object of the invention is to provide a pulverizing roll, as aforesaid, in which the roll member is positively prevented from rotating relative to the tapered threaded shaft.

Still another object of the invention is to provide a pulverizing roll having no parts which require more than minimal machining or grinding when the roll is replaced.

A still further object of the invention is to provide a pulverizing roll in which the only member which requires precision machining can be used indefinitely.

A further object of the invention is to provide a pulverizing roll in which the axial position of the roll member on the shaft can be simply adjusted.

Another object of the invention is to provide an improved method of mounting a pulverizing roll on a tapered shaft in a manner such that the shaft will not be damaged.

Yet another object of the invention is to provide an improved method of mounting a pulverizing roll on a tapered shaft so that after extended periods of use, the roll member is less likely to fall off the shaft.

A further object of the invention is to provide an improved method of mounting a pulverizing roll on a tapered shaft which provides for simpler, quicker and less costly replacement of the roll member than conventional methods.

Another object of the present invention is to provide an improved method of mounting a pulverizing roll on a tapered shaft which provides a positive nonrotatable and otherwise immovable connection between the roll member and shaft.

Other objects and advantages of the invention will become apparent from the following detailed description and with reference to the accompanying drawings.

BRIEF DESCRIPTION OF DRAWINGS

In the drawings

FIG. 1 is a schematic perspective view of the portion of a roller mill incorporating pulverizing rolls in accordance with the invention;

FIG. 2 is an exploded, partially sectional, perspective view of a pulverizing roll assembly in accordance with the present invention;

FIG. 3 is an axial sectional view of the pulverizing roll assembly of FIG. 2, in an assembled condition;

FIG. 4 is one form of a pulverizing roll of the prior art;

FIG. 5 is another form of a pulverizing roll of the prior art;

FIG. 6 is a view similar to FIG. 3 showing a modified roll assembly in accordance with the invention;

FIG. 7 is a perspective view of the insert portion of FIG. 6; and

FIG. 8 is a side view of the insert of FIG. 7.

DETAILED DESCRIPTION OF A PREFERRED EMBODIMENT

Environment of the Invention

With reference to the drawings, FIG. 1 shows the pulverizing portion of a roller mill 10 of the type with which the pulverizing rolls of the present invention are adapted to be used. The mill includes a central rotor drive shaft 12 which extends upwardly through a pulverizing ring 14 and is mounted at its upper end to a rotor 16. The rotor pivotally mounts a number of roll-supporting arms 17 for radially outward swinging movement under the influence of centrifugal force upon rotation of the rotor. Each arm 17 has a lower end portion comprising a tapered shaft 24, as shown in FIGS. 2 and 3. Tapered shaft 24 is rotatably mounted in a conventional manner by bearings (not shown) within arm 17. A pulverizing roll 18 is affixed to each tapered shaft 24 to rotate with the shaft. As shown in FIG. 2, each tapered shaft 24 terminates in a threaded end 26 which receives a nut 28 for securing the pulverizing roll 18 on the shaft. Rolls 18 interact with the inner face 20 of ring 14 upon rotation of rotor 16 to pulverize material fed into the ring.

The roller mill as described thus far is of conventional construction. It should be understood that various types of roller mills have various means for mounting the pulverizing rolls to the arms 17. However, this invention has application only to roller mills of the type in which the arms 17 mount the pulverizing rolls 18 by means of the threaded tapered shaft 24 described.

Pulverizing Rolls of the Prior Art

FIG. 4 discloses a pulverizing roll **18*a* of a type which has been previously used for mounting on the threaded tapered shaft 24 of FIGS. 2 and 3. Such roll may be made of a cast white iron, a high chromium white iron, or other suitable hard materials which are difficult and costly to hand grind or precision machine. The roll 18*a* has an inner wall which defines a precision tapered bore 30 tapered to receive tapered shaft 24** and is hand ground or precision machined for this purpose. Grinding or machining is necessary with a roll of this type because, given normal industrial casting tolerances, it is impossible to cast a roll with enough precision for proper fit on the shaft. Since little can be done if the roll is cast with an oversized bore, the roll must be cast with an undersized bore and machined or ground to the proper dimension. Because the bore wall is extremely hard, the machining or hand grinding operation renders the roll extremely expensive to manufacture. When the roll wears out, typically after a few months of use, the entire roll must be replaced with a similar, costly roll.

FIG. 5 shows another roll **18*b*, which has been previously used in roller mills having a tapered shaft-type roll mount. In such a roll, the outer hard cast portion 32 is cast about a premanufactured inner sleeve 34 which has a tapered axial bore 36. The tapered bore 36 is precision machined to receive the tapered shaft 24 of FIG. 1. Because the inner sleeve 34 is typically made of a machineable metal, such as mild steel, the precision machining of the tapered bore is considerably simplified over that required for roll 18*a*. Nevertheless, when roll 18*b* wears out, the entire roll, including inner sleeve 34**, must be discarded and replaced with a similar, still costly roll.

Roll Construction of Invention

The roll construction of the present invention, shown in FIGS. 2 and 3, includes an outer, generally cylindrical roll member 40 and an annular end insert 52 insertable within a recess in one end face of the roll member. Roll member 40 has an axial bore and is made of a cast white iron, a chromium-white iron, or other suitable hard material. The axial bore is defined by a first bore end wall portion 44, central bore wall portion 42 and a second bore end wall portion 48.

First bore end wall 44 has a larger radial dimension than central bore wall 42 and intersects an end face 46 of roll member 40 to define a noncircular, polygonal shaped recess within roll member 40. First bore end wall 44 meets central bore wall 42 at an annular shoulder 50 which has an axially extending annular lip 51.

Central bore wall 42 is of larger radial dimension than second bore end wall 48. In the preferred embodiment, central bore wall 42 has a circular axial cross section and a radial dimension large enough to provide a clearance for tapered shaft 24 after the mounting of roll 40 on shaft 24. The radial dimension of central bore wall 42 is noncritical and requires no machining or grinding. As a result, this portion of roll member 40 can be used in its as-cast condition.

Second bore end wall 48 has an axially tapered inner wall which is conveniently of circular axial cross section, although it could also be of noncircular cross section. The radial dimension of second bore end wall 48 is sized to provide slight clearance between it and shaft 24 when roll member 40 is mounted on shaft 24. Again, because the radial dimension of second bore end wall 48 is noncritical, roll member 40 can be used in its as-cast condition. As with central bore wall 42, second bore end wall 48 can be machined so as to precisely fit shaft 24. However, the result is a much more costly roll member 40. Alternatively, roll member 40 can be cast to provide substantial clearance between second bore end wall 48 and shaft 24.

Annular end insert 52 has a peripheral wall 76 of a size and shape complemental to the noncircular recess formed by first bore end wall 44 and is insertable within the recess. Such insert is preferably made of a material which can be readily precision machined, such as a mild steel. It has an axial bore 58 which is precision machine tapered, as shown best in FIG. 3, so that the taper closely conforms to the taper of tapered shaft 24 on which roll member 40 is to be mounted. The size and taper of bore 58 is critical and determines the position of the roll member 40 along the axis of shaft 24.

When insert 52 is fully inserted within the recess of first bore end wall 44, it abuts lip 51 which together with shoulder 50 define an abutment means for insert 52. Insert 52 preferably has a thickness which is approximately the same as the depth of the recess so that, when in abutment with the abutment means, outer face 56 of insert 52 is generally flush with adjacent end face 46 of roll member 40, as shown in FIG. 3.

Method of Mounting

From the foregoing description of the construction of pulverizing roll 18, its manner of use will be evident. After insert 52 is mounted on shaft 24 with its axially tapered bore 58 in snug engagement with shaft 24, roll member 40 is placed on shaft 24 so that the recess defined by first bore end wall 44 receives insert 52. Roll member 40 is then secured by nut 28 on threaded end portion 26 of shaft 24. Once in place, insert 52 is secured, preferably by welding, to shaft 24, as shown at 22 in FIG. 2. Insert 52 is thus prevented from rotating about shaft 24. Because of the complementary noncircular shapes of insert 52 and first bore end wall 44 and their close fit, roll member 40 cannot rotate about insert 52, and therefore roll 18 is positively prevented from rotating about shaft 24.

Minor adjustments in the axial position of roll member 40 with respect to insert 52 can be made by lightly grinding lip 51. Lip 51 serves an additional purpose by providing clearance between the interior end face of insert 52 and shoulder 50. This enables the annular corner where shoulder 50 meets first bore end wall 44 to be curved. This is important because it is almost impossible to cast square interior corners using conventional casting techniques. Further, casting imperfections in shoulder 50 will not affect the axial position of roll 50.

After a period of use, roll member 40 will wear out. When this occurs, it is removed from tapered shaft 24 after unscrewing nut 28. Insert 52 remains affixed to shaft 24. A new roll member is then mounted on tapered shaft 24 so that insert 52 fits within the recess of the new roll member, and nut 28 secures the roll member in place. As a result, only roll member 40 need be discarded when worn-out.

From the foregoing, it will be apparent that a precise fit of pulverizing roll 18 on shaft 24 is required only where insert 52 is in contact with shaft 24. While the bore of insert 52 must be precision machined, the clearance between shaft 24 and roll member 40 at central bore wall 42 and second bore wall 48 enables roll member 40 to be used in its as-cast condition. As previously explained, the axial position of roll member 40 with respect to insert 52 can be adjusted by grinding lip 51.

FIG. 6 Embodiment

Referring to FIGS. 6,7, and 8, a modified form of roll assembly **18*c* is shown which is similar to the roll assembly 18 of FIG. 3** except for the shape of the reusable bore end insert and the cooperative shoulder portion of the first bore end wall.

Roll assembly **18*c* includes the outer generally cylindrical roll member 60 and an annular end insert 62 insertable within a recess in one end face 70 of the roll member. Roll member 60 has an axial bore defined by a first bore end wall portion 64, a central bore wall portion 66, and a second bore end wall portion 68**.

First bore end wall portion 64 has a larger radial dimension than central bore wall portion 66 and intersects an end face 70 of roll member 60 to define a noncircular, polygonal-shaped recess within roll member 40. First bore end wall 64 includes a spherically tapered shoulder 72 which meets central bore wall 66.

The relative sizes, shapes, and relationship between central bore wall 66 and second bore end wall 68 are the same as with the corresponding portions of the roll member of FIG. 3. Central bore wall 66 has a radial dimension large enough to provide a clearance for tapered shaft **24*a* after the mounting of roll 60** on such shaft.

Annular end insert 62 has a peripheral wall 76 of a size and shape complemental to the noncircular recess formed by first bore end wall 64 and is insertable within such recess. Insert 62 also has a spherically tapered wall portion 78 which extends from peripheral wall 76 to an intersection with a tapered axial bore 74 of the insert. The convex spherically tapered wall surface 78 has a taper which conforms to the concave spherical taper of shoulder surface portion 72 of the roll member. Thus, when insert 62 is inserted within the recess formed by first bore end wall portion 64, tapered insert wall 78 nests against tapered shoulder 72 for a purpose described below.

Insert 62 is preferably made of a material which can be readily precision machined, such as a mild steel. Its axial bore 74 is precision machine tapered, as shown best in FIG. 6, so that the taper closely conforms to the taper of tapered shaft **24*a* on which roll member 60 is mounted. The size and taper of bore 74 is critical in that it determines the position of the roll member 60 along the axis of shaft 24*a***.

When insert 62 is fully inserted within the recess formed by first bore end wall 64 and tapered shoulder 72, its spherically tapered wall 78 mates with shoulder 72 to define an abutment means for the insert. Insert 62 preferably has a thickness which is approximately the same as the depth of the recess so that, when in abutment with shoulder 72, an outer face 80 of insert 62 is generally flush with the adjacent end face 70 of roll member 60.

After insert 62 is mounted on shaft 24*a* with its axially tapered bore 74 in snug engagement with shaft 24*a*, roll member 60 is placed on shaft 24*a* so that the recess defined by first bore end wall 64 receives insert 62. Roll member 40 is then secured by a nut 28*a* on threaded shaft end portion 26*a*. Once in place, insert 62 is secured, preferably by spot-welding, to shaft 24*a*, as shown at 22*a* in FIG. 6 and at 22 in FIG. 2. Insert 62 is thus prevented from rotating relative to shaft 24*a*. Because of the complementary noncircular shapes of insert 62 and first bore end wall 64 and their close fit, roll member 60 cannot rotate about insert 62, and therefore roll 18*a* is positively prevented from rotating about shaft 24*a*.

Also, because of the complementary spherical tapers of shoulder surface 72 of the roll member and tapered wall surface 78 of the insert, the insert is drawn into close abutting relationship with the shoulder when nut 28*a* is tightened on threaded shaft portion 26*a*, creating a lateral as well as axial interference fit between the roll and insert surfaces. The laterally interfering tapered surfaces 72,78 resist any tendency of the mild steel insert 62 to move laterally, or perpendicular to the axis of the bore, of roll member 60, thereby resisting any tendency for the relatively hard roll member to work loose and damage the insert during use. Without such laterally interfering surfaces, the relatively large tolerances between the typically unmachined first bore end wall surfaces 64 and insert sidewalls 76 could allow some slight relative lateral movement between the roll member and insert, therefore enabling the roll eventually to work loose to an unacceptable extent and damage the insert and possibly the shaft. The resistance to lateral movement of the insert 62 relative to roll member 64 provided by the laterally interfering surfaces 72 of the roll member and 78 of the insert is an important advantage of the roll assembly of FIG. 6 over that shown in FIG. 3, the latter of which has no equivalent laterally interfering surfaces.

Except for the laterally interfering surfaces of the roll assembly of FIG. 6, however, such assembly is used and operates in the same manner as the roll assembly of FIG. 3. The roll member of FIG. 6 is also replaced in the same manner as the roll member of FIG. 3 when worn out. This is done simply by removing nut 28*a* and replacing the worn out roll member 60 with a new roll member while insert 62 remains attached to tapered shaft 24*a*. Thereafter, nut 28*a* is again threaded onto the shaft and tightened to renew the laterally interfering relationship between the tapered abutting surfaces of the insert 62 and new roll member 60.

It is important to note that the laterally interfering surfaces 72 and 78 of the roll member and insert, respectively, need not be spherically tapered as shown in FIGS. 6, 7, and 8, but instead can be conically tapered if desired. However, the spherical taper does have the advantage of allowing the roll member to more easily adjust to any angular deviation of the axis established by the nut 28*a* from the axis of the bore of the roll member. Although theoretically there is no deviation, manufacturing imperfections could result in a slight angular deviation whereby nut 28*a* would not be quite perpendicular to the axis of the bore of the roll member.

In any case, with the suggested design of FIGS. 3 and 6, no precision machining or grinding of the roll member is required. It can be used essentialy as cast, with only touch-up hand grinding needed to eliminate any flash and to smooth casting imperfections.

Other Embodiments

With reference to FIG. 3 and in manufacturing the roll assembly of FIG. 3 or of FIG. 6, the reusable bore end insert 52 is premanufactured to acceptable tolerances. This includes precision machining of the bore taper of the insert to accurately determine the position of the roll on the shaft.

It is important to emphasize that the cross sectional shape of first bore end wall portion 44 is not critical. It is only necessary that the peripheral size and shape of insert 52 conform to whatever configuration is selected for first bore end wall 44. In this connection, the interfitting surfaces of insert 52 and first bore end wall 44 of roll member 40 could comprise one or more keys and keyways or dovetails, or could be of any irregular shape effective to prevent relative rotation therebetween. Keys and keyways could be used with circular, as well as noncircular, inserts.

Having illustrated and described the principles of my invention by what is presently a preferred embodiment and several suggested alternatives, it should be apparent to those persons skilled in the art that such embodiments may be modified in arrangement and detail without departing from such principles. I claim as my invention all such modifications as come within the true spirit and scope of the invention as defined by the following claims:

1. A roll assembly for a roller mill comprising:

a generally cylindrical roll member having an axial bore, the bore being defined by a central bore wall portion and a first bore end wall portion of greater radial dimension than said central bore wall portion so as to form an annular shoulder between said first bore end wall portion and said central bore wall portion, said first bore end wall portion intersecting an end face of said roll member to define a recess within said end face, a generally annular end insert adapted for nonrotatable mounting within said recess and in abutment with said shoulder to positively engage said roll, said insert having an axial bore defined by a tapered bore wall, a tapered shaft having a taper corresponding to the taper of the bore wall of said insert, said shaft being insertable through the axial bores of said roll member and said insert and into abutment with the bore wall of said insert to determine the position of the roll member along said shaft, said shaft terminating in a threaded end portion, and a threaded nut member for threading on said threaded end portion and thereby forcing said roll member into secure abutment against said insert, said annular shoulder comprising an annular tapered surface and said end insert including a mating annular tapered face in abutment against said tapered surface to provide lateral interference therebetween when said nut is threaded onto said threaded end portion and firmly against said roll member, thereby to restrain said roll member against lateral and axial movement relative to said insert.

2. A roll assembly according to claim 1 wherein said insert is affixed to said shaft in a position along said shaft in which the tapered bore wall of said insert abuts the correspondingly tapered shaft.

3. A roll assembly according to claim 2 wherein said roll member is composed entirely of a hard, cast wear-resistant material and said insert is composed entirely of a readily machineable material.

4. A roll assembly according to claim 3 wherein said central bore wall portion is sized to clear said shaft when said roll member is mounted on said shaft with said insert within said recess and said bore wall of said insert in abutment with said shaft.

5. A roll assembly according to claim 1 wherein said tapered surfaces are spherically tapered.

* * * * *